US007484738B2

(12) United States Patent
Belt

(10) Patent No.: US 7,484,738 B2
(45) Date of Patent: Feb. 3, 2009

(54) MULTI-EDGE SNOWBOARD

(75) Inventor: R. Todd Belt, Mountain View, CA (US)

(73) Assignee: Deuce Snowboards, LLC, Sunnyvale, CA (US)

( * ) Notice: Subject to any disclaimer, the term of this patent is extended or adjusted under 35 U.S.C. 154(b) by 221 days.

(21) Appl. No.: 11/263,760

(22) Filed: Oct. 31, 2005

(65) Prior Publication Data

US 2006/0091623 A1 May 4, 2006

Related U.S. Application Data

(60) Provisional application No. 60/624,480, filed on Nov. 1, 2004.

(51) Int. Cl.
*B62B 13/12* (2006.01)
*A63C 5/16* (2006.01)

(52) U.S. Cl. ..... 280/14.26; 280/15; 280/16; 280/818

(58) Field of Classification Search ..... 280/818, 280/14.25, 14.26, 15, 16, 17, 22.1, 26, 28.15, 280/28.16

See application file for complete search history.

(56) References Cited

U.S. PATENT DOCUMENTS

| | | | | | |
|---|---|---|---|---|---|
| 1,600,735 | A * | 9/1926 | Pederson | 280/21.1 |
| 3,862,764 | A * | 1/1975 | Hartz | 280/818 |
| 4,334,691 | A * | 6/1982 | Scheib | 280/14.1 |
| 4,449,735 | A * | 5/1984 | McDougall | 280/818 |
| 4,453,742 | A * | 6/1984 | Zepkowski | 280/818 |
| 4,796,902 | A * | 1/1989 | Capra | 280/16 |
| 5,000,466 | A * | 3/1991 | Den Hartog | 280/21.1 |
| 5,161,810 | A * | 11/1992 | DeCesare | 280/14.21 |
| 5,558,354 | A * | 9/1996 | Lion | 280/607 |
| 6,113,115 | A * | 9/2000 | Hurth | 280/15 |
| 6,682,083 | B2 | 1/2004 | Melcher | |
| 2002/0185828 | A1 * | 12/2002 | Melcher | 280/14.26 |

* cited by examiner

*Primary Examiner*—Frank B Vanaman
(74) *Attorney, Agent, or Firm*—David T. Millers

(57) ABSTRACT

A multi-edge snowboard includes multiple boards with attached bindings. A pivot mechanism that connects the bindings to the boards rotates each board, so that each board can provide an active edge that engages the snow during turning or stopping. The increase in the number of active edges relative to a conventional snowboard improves the performance of the multi-edge snowboard, while the binding structure retains the feel of a conventional snowboard.

9 Claims, 4 Drawing Sheets

MULTI-EDGE SNOWBOARD

CROSS-REFERENCE TO RELATED APPLICATION

This patent document claims benefit of the earlier filing date of U.S. Provisional patent application 60/624,480, filed Nov. 1, 2004, which is hereby incorporated by reference in its entirety.

BACKGROUND

Snowboarding has several advantages and disadvantages relative to skiing. For example, snowboarding has the advantages of being easier to learn, being easier on leg joints, providing better control in powder conditions, and having a general motion similar to surfing. However, snowboarders seem to be involved in a disproportionate share of collisions. There are several reasons that could explain the higher collision rate for snowboards, but one reason that is particularly instructive on the technical shortcomings of conventional snowboards is that snowboarders have less chance of avoiding collisions since the snowboards generally require wider turns and longer stopping distances when compared to skis. The reduced ability to avoid accidents when compared to skis may result because snowboards have only one short edge cutting into the snow compared to the two long edges that skis provide. Accordingly, a snowboard that provides improved turning and stopping abilities could improve safety. Further, the improved maneuverability can greatly enhance the sport of snowboarding by making snowboards more dynamic and responsive.

SUMMARY

In accordance with an aspect of the invention, a snowboard with a multi-board structure can provide multiple edges that cut into the snow. The multi-edge snowboard improves stopping distance and turning radius by providing multiple edges that engage the snow while being kept together and parallel. During a turn, multiple boards can rotate up onto their respective uphill/inside turning edges, thus minimizing the required motion and evenly distributing the weight across the edges. A multi-edge snowboard can thus provide higher performance than conventional snowboards and still retain the desired snowboarding attributes such as ease of learning and the feel of surfing.

In accordance with a further aspect of the invention, multi-edge snowboards provide the opportunity for mechanical improvements into the sport, for example, by addition of suspension systems and shock absorbers. Spring-dampening suspension systems between bindings and boards, for example, can reduce the shock from hard landings, and such systems can be customizable for more individual choice. Further, these systems capabilities can improve responsiveness when compared to skiing. In particular, for skiing, the rotation onto the uphill edges generally results in a large portion of the skier's weight being put onto the downhill ski since the uphill ski leg must generally be bent more to comply to the motion of the downhill ski. In contrast, a multi-edge snowboard can achieve a more even distribution of weight on the active edges.

In addition to improved safety through collision avoidance, some of advantages that certain embodiments of the invention may provide over conventional snowboards include: improved grip on hard pack and ice; greater ability to carve; a forgiving leading edge; a smoother ride (e.g., through independent suspension); improved longitudinal flex for more bounce; and no toe/heel drag.

One specific embodiment of the invention is a snowboard that includes multiple boards, a mechanism connecting the boards, and a platform on which a snowboarder can stand. In general, the mechanism causes relative movement of the boards to create multiple active edges, and the platform is attached to the mechanism so as to permit the snowboarder to control the multiple active edges.

Another specific embodiment of the invention is a device such as but not limited to a snowboard, a ski, handicapped snow sport gear, or a slide portion of a conveyance such as a snowmobile. The device includes a first board with first vertical link attached, a second board with a second vertical link attached, first and second horizontal links, and a drive link. The first horizontal link is attached to the first vertical link and the second vertical link, and the attachments of the first horizontal link to the vertical links permit changes in the angle between the first horizontal link and the respective vertical links. The first and second vertical links attach to the first and second boards, and the drive link attaches to the first and second horizontal links. The attachments in the device are generally such that movement of the drive link shifts the first horizontal link relative to the second horizontal link and rotate the first and second boards; which are effectively extensions of the first and second vertical links.

Yet another embodiment of the invention is a method of using a conveyance when the conveyance includes a mechanism having: a first vertical link attached to a first board; a second vertical link attached to a second board; a first horizontal link attached to the first vertical link and the second vertical link; and a second horizontal link attached to the first and second boards. The attachments of the first horizontal link to the vertical links permit changes in angles between the first horizontal link and the respective vertical links. The method includes shifting the second horizontal link relative to the first horizontal link, wherein the shifting rotates the first and second boards, creating edges that contact an underlying surface for steering of the conveyance.

BRIEF DESCRIPTION OF THE DRAWINGS

Use of the same reference symbols in different figures indicates similar or identical items.

DETAILED DESCRIPTION

In accordance with an aspect of the invention, a multi-edge snowboard includes multiple boards with attached snowboard bindings. A pivot structure connects the bindings to the boards and rotates each board, so that each board can provide an active edge that engages the snow during turning or stopping. The increase in the number of active edges relative to a conventional snowboard improves the performance of the multi-edge snowboard, while the binding and overall structure can retain the feel of a conventional snowboard.

Figure 1A:
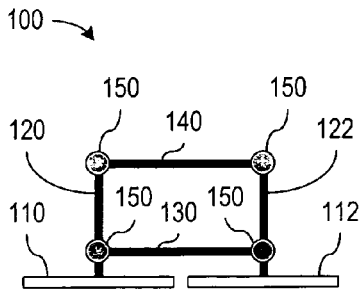
FIGS. 1A and 1B show front views of a multi-edge snowboard in configurations respectively for straight travel and turning.

One mechanical goal of a multi-edge snowboard is that the boards and the bindings remain roughly parallel through a full range of motion. FIG. 1A shows a front view of a multi-edge snowboard 100 employing a four-bar mechanism for control of the orientation of boards 110 and 112. The four-bar mechanism includes two vertical bars/links 120 and 122, a lower horizontal bar/link 130, and an upper horizontal bar/link 140. Vertical links 120 and 122 are rigidly attached transversely to respective boards 110 and 112 and are preferably perpendicular to the surfaces of boards 110 and 112. Pivots 150 attach the ends of lower link 130 and upper link 140 to vertical links 120 and 122 to form a parallelogram. As described further below, multiple four-bar mechanisms of similar or identical construction can be provided at points separated along the lengths of boards 110 and 112 and connected to a binding platform not shown in FIG. 1A.

Boards 110 and 112 can be made of same materials conventionally employed in snowboards and skis, for example, a multi-layer or composite structure including materials such as a plastic (e.g., ultra high molecular weight polyethylene) base, glass or carbon fiber with an epoxy matrix, a wood or foam core, steel inserts, metal edges, a resin system (e.g., glue), rubber foil, and a top sheet with printed graphic. The length of each board 110 or 112 is preferably the same as that of a standard snowboard, and also the combined surface area of boards 110 and 112 is preferably the same as a conventional snowboard. Accordingly, these dimensions would commonly be selected based on the height and weight and the personal preferences of the snowboarder. The most significant design change from the dimensions of conventional snowboards is that the thickness function of boards 110 and 112 should be increased (e.g., to about 8 mm) in the center of boards 110 and 112 where mechanisms (e.g., links 120 and 122) attach to boards 110 and 112. From the center, boards 110 and 112 can taper down to a more conventional snowboard thickness (e.g., about 5 to 6 mm) at the tips.

Links 120, 122, 130, and 140 are preferably made of a durable light weight material such as aluminum, epoxy composites, titanium, beryllium, and other similar metals or high performance plastics. Vertical links 120 and 122, which are rigidly attached to respective boards 110 and 112, can be molded or otherwise formed to have a flat or extended base area that can be integrated into or mechanically attached to respective boards 110 and 112. The heights of vertical links 120 and 122 are preferably less than a few centimeters, and lengths of horizontal links will depend on the widths of boards 110 and 112, the separation between boards 110 and 112, and the locations where vertical links 120 and 122 attach to boards 110 and 112. In typical configurations, horizontal links 130 and 140 may be about 20 to 40 cm long.

Pivots 150 can be part of a modified universal joint system that allows a wide range of 4 bar mechanism movement and, with respect to the vertical link and its associated board, a minor amount of longitudinal rotation, but no transverse rotation. Pivots 150 can be modified universal joints in the sense that the two orthogonal axis of rotation of each pivot 150 are preferably not in the same plane, but offset by tens of millimeters. The longitudinal rotation degree of freedom is to stop board induced bending stresses from being transmitted to the mechanism. Each joint 150 is preferably made of a stainless steel pin riding in a pair of durable, oil safe, dry bushings such as oil impregnated bronze or a PTFE lined bushing. Alternatively, a further enhancement of each pivot 150 can replace the universal joint's two axes of rotation with a ball joint.

Figure 1B:
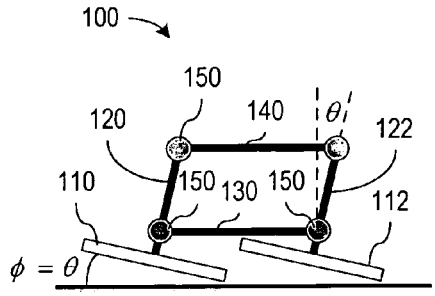

With boards 120 and 122 rigidly attached perpendicular to each of respective vertical links 120 and 122, the boards 110 and 112 remain parallel to each other when link 140 is shifted relative to link 130. FIG. 1A shows a configuration of multi-edge snowboard 100 where the centers of links 130 and 140 are aligned and boards 110 and 112 are coplanar, for example, for travel in a straight line. An edge rotation of boards 110 and 112 as shown in FIG. 1B results when upper link 140 shifts slightly relative to lower link 130. The rotated edges of boards 110 and 112 can cut into snow for turning or stopping. A simultaneous relative edge translation of boards 110 and 112 is coincident with edge rotation and may slow the response time of the mechanism. In preferred embodiment of the invention, translation of boards 110 and 112 is on the order of 1 cm through the entire range of rotation of boards 110 and 112.

Figure 2A:
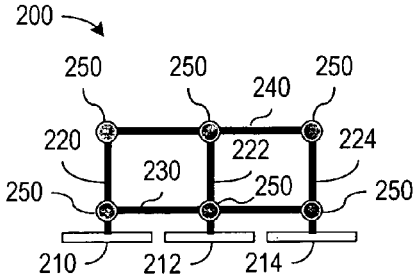
FIGS. 2A and 2B show front views of a three-board snowboard in configurations respectively for straight travel and turning.
Figure 2B:
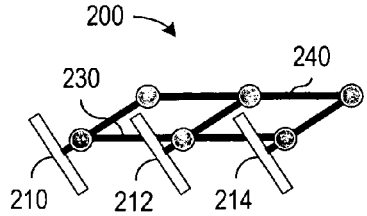

Multi-edge snowboards in accordance with some embodiments of this invention are not limited to having two boards and could include three or more boards. Even with three or more boards, a mechanism for binding the boards can use vertical links rigidly attached to the boards and pivotally attached to upper and lower horizontal links in a manner similar to that illustrated in FIGS. 1A and 1B. FIGS. 2A and 2B, for example, show a multi-edge snowboard 200 including three boards 210, 212, and 214 respectively attached vertical links 220, 222, and 224. Pivots 250 connect a pair of horizontal links 230 and 240 to vertical links 220, 222, 224. FIG. 2A shows multi-edge snowboard 200 in a configuration where boards 210, 212, and 214 are co-planar, for example, for traveling in a straight line. FIG. 2B shows multi-edge snowboard 200 in a configuration where a shift of upper link 240 relative to lower link 230 caused rotation of boards 210, 212, and 214, for example, to provide multiple edges that cut into snow for turning or stopping. Increasing the number of boards generally increases the number of edges and may improve performance. However, using a larger number of boards generally requires a larger part count and correspondingly a higher manufacturing cost.

Figure 3:
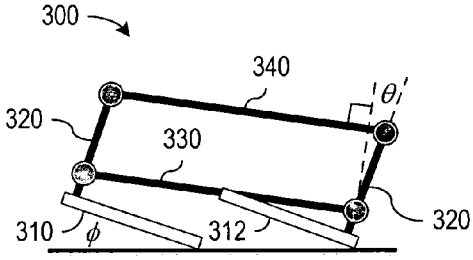
FIG. 3 shows a front view of a multi-edge snowboard in accordance with an embodiment of invention using offset vertical links.

An exemplary embodiment of a multi-edge snowboard provides a total snowboarder tilt, relative to the ground, of at least 45° and snowboarder elevation less than 100 mm above the boards. Various common variables to the four-bar mechanism can be optimized to achieve these characteristics. In accordance with an aspect of the invention, one structural variable in multi-edge snowboard construction is the use of an offset of the vertical links relative to the center of the boards. Snowboard 100 of FIGS. 1A and 1B illustrates an embodiment in which vertical links 120 and 122 are at the center of respective boards 110 and 112. FIG. 3 shows a-snowboard 300 having vertical links 320 and 322 that are offset toward outer edges of the respective boards 310 and 312. This allows a rotation of vertical links 320 and 322 to cause one board 310 or 312 to lift one side of snowboard 300 more than the other board 312 or 310 lifts snowboard 300. The angle $\phi$ that boards 310 and 312 make with the snow is thus greater than the shift angle $\theta$ of the parallelogram formed by links 320, 322, 330, and 340. For example, an edge $\phi$ rotation of 45° relative to the mountain surface might be achieved with only a 30° rotation of vertical links 320 and 322 relative to horizontal links 330 and 340. More generally, the geometry of the links 120, 122, 130, and 140 relative to boards 110 and 120 can be designed to control the relation of edge rotation angle $\phi$ to shift angle $\theta$.

Figure 4A:
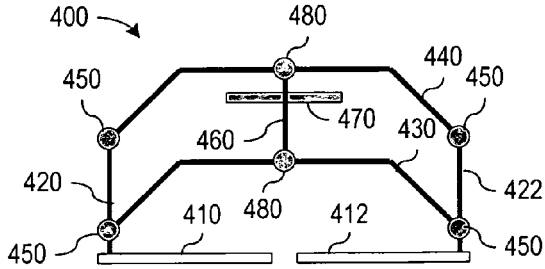
FIGS. 4A and 4B respectively show front and top views of a two-board snowboard with a central binding platform.
Figure 4B:
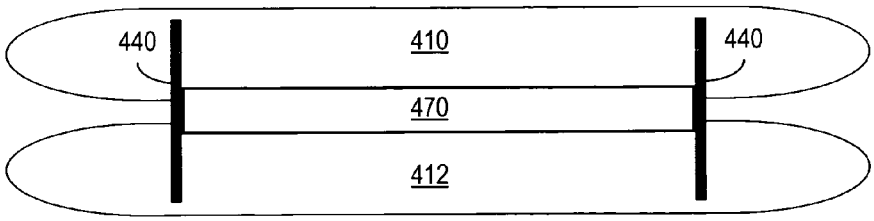

FIGS. 4A and 4B respectively show front and top views of a multi-edge snowboard 400 that includes arched horizontal links 430 and 440. Boards 410 and 412 with attached vertical links 420 and 422 are pivotally connected to arched horizontal links 430 and 440 to form a four-bar mechanism as described above. Use of an arched lower link 430 has the advantage of providing additional space for rotation of boards 410 and 412.

Multi-edge snowboard 400 also illustrates a mechanism permitting a snowboarder to control rotation of boards 410 and 412. In an exemplary embodiment, a snowboarder operates the four-bar mechanisms described above via a moment induced by a shift of the snowboarder's weight, for example, the snowboarder leaning into a turn in order to maintain a balance between gravitational and centripetal forces. FIG. 4A illustrates one embodiment in which each four-bar mechanism includes a drive link 460 that is parallel to vertical links 420 and 422 and attached to horizontal links 430 and 440 via pivots 480. A binding platform 470 as shown in FIGS. 4A and 4B is rigidly attached to drive links 460 in a pair of four-bar mechanisms near opposite ends of boards 410 and 412. A snowboarder can operate this system and cause boards 410 and 412 to rise up onto two edges by standing on binding platform 470 and tipping his or her feet forward or backward (tip-toes or heals). Thus, multi-edge snowboard 400 and the snowboarder move in parallel in the same way as with conventional snowboards.

As described above, multi-edge snowboard 400 has two four-bar mechanisms, one fore and one aft on boards 410 and 412, and both four-bar mechanisms connect boards 410 and 412 to binding platform 470. A longitudinal beam running the length of platform 470 can connect drive links 460 in both four-bar mechanisms and close the longitudinal structural loop. This basic structure for connecting and driving two or more boards can be altered or rearranged in a variety of ways and can be augmented with additional features such as compliant structures (i.e. springs and dampers). Different arrangements will generally have their own advantages and disadvantages. For example, a relatively stiff assembly might be preferable for use on a slalom run, while a more flexible assembly might be preferable for moguls.

Figure 5A:
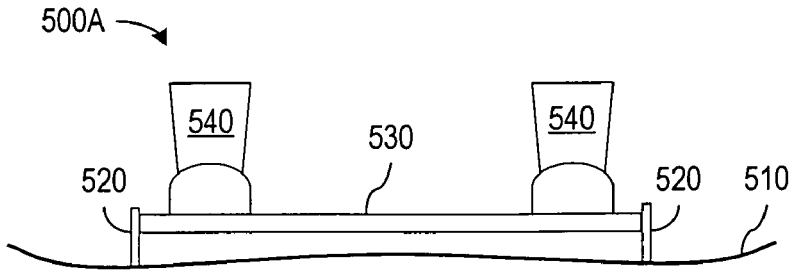
FIGS. 5A, 5B, 5C, and 5D show side views of multi-edge snowboards in accordance with embodiments of the invention having alternative binding/drive structures.

FIG. 5A shows a side view of multi-edge snowboard 500A having substantially the same driving system as described above with reference to FIGS. 4A and 4B. In particular, snowboard 500A includes multiple boards 510 that are connected by fore and aft multi-bar mechanisms 520. Multi-bar mechanisms 520 connect to the ends of a binding platform and drive assembly 530 on which bindings 540 for a snowboarder's feet are mounted. Snowboard 500A is structurally sound, simple and in many ways similar in appearance to a conventional snowboard. The fore-and-aft arrangement of mechanisms 520 creates one of the lowest bending stresses on the bearings/pivots. Snowboard 500A can still be made compliant to longitudinal torsion that result when the snowboarder applies different pressures through fore and aft bindings 540 or compliant to forward or backward moments at the mechanism-to-board interfaces.

Figure 5B:
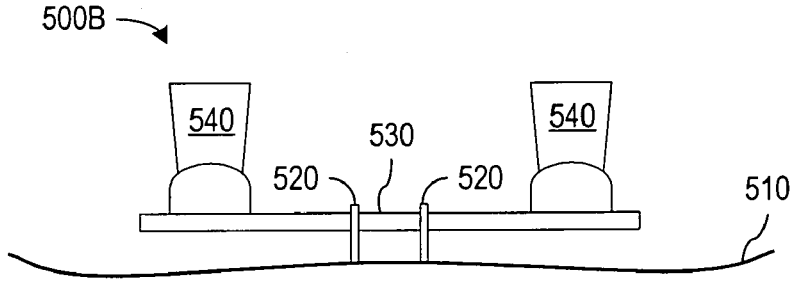

FIG. 5B shows a multi-edge snowboard 500B having two multi-bar mechanisms 520 that are to some degree rigidly attached to binding platform 530. The key difference between snowboards 500A and 500B is that mechanisms 520 are placed within the instep of the snowboarder, i.e., between bindings 540. One of the key advantages of multi-edge snowboard 520 is that the closer spacing of mechanisms 520 allows boards 510 to naturally bow. Another advantage is that snowboard 500B is more accommodating to addition of a spring-damper mechanism such as described further below. However, the ability of a snowboarder to induce a longitudinal twist of snowboard 500B is more limited than in snowboard 500A.

Figure 5C:
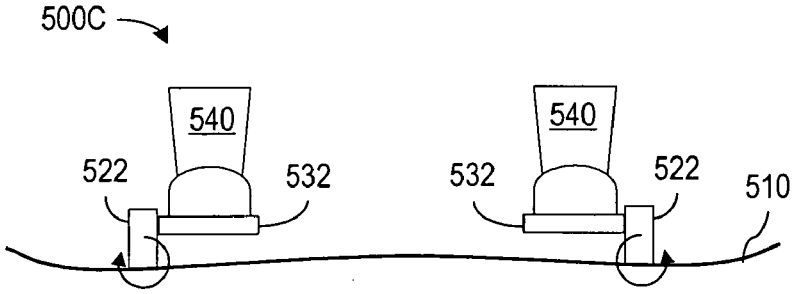

FIG. 5C illustrates a multi-edge snowboard 500C having cantilevered binding platforms 532 that are separated from each other. To support the cantilevered structure, four-bar mechanisms 522 may need to be more robust than (but otherwise identical in operation to) the four-bar mechanism 520 used in snowboard 500A or 500B. In particular, mechanisms 522 may require stronger bearings, and might be more expensive, heavier, and/or bulkier than snowboard 500A or 500B. However, multi-edge snowboard 500C provides a dynamic system, in that snowboard 500C allows both differential longitudinal twist and bowing of boards 510 between the fore and aft mechanisms 522.

Figure 5D:
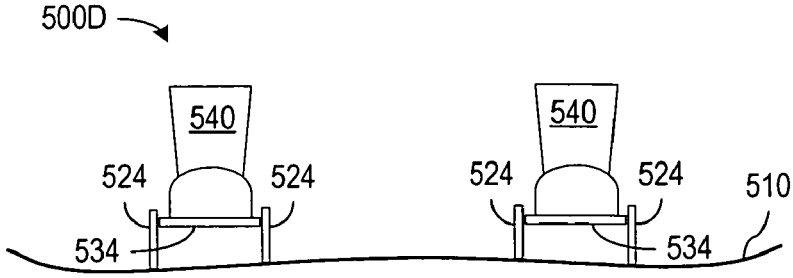

FIG. 5D illustrates a multi-edge snowboard 500D that offers a compromise between the cantilevered binding platforms 532 of snowboard 500C and the end-supported binding platform 530 of snowboard 500A. Snowboard 500D includes separated fore and aft binding platforms 534, and each binding platform 534 is supported by a pair of multi-bar mechanisms 524. This configuration does not hinder differential longitudinal twist, but attempts to mitigate the detrimental bending moment on the multi-bar mechanisms 522 in snowboard 500C. However, snowboard 500D may be more expensive and possibly heavier than some other snowboard embodiments.

In accordance with another aspect of the invention, a spring/damper system can be added to a multi-edge snowboard. One categorization of a spring-damper subsystem is in terms of being either structurally or mechanically oriented. In this case, structurally oriented implies that the compliance is designed into the normally stiff links. Mechanically oriented refers to no changes in the core construction, but adds additional mechanisms to effect compliance. Structural spring-dampers have the advantages of potentially requiring less volume, parts, weight and cost; whereas mechanism spring-dampers may be more cross platform adaptable.

Figure 6A:
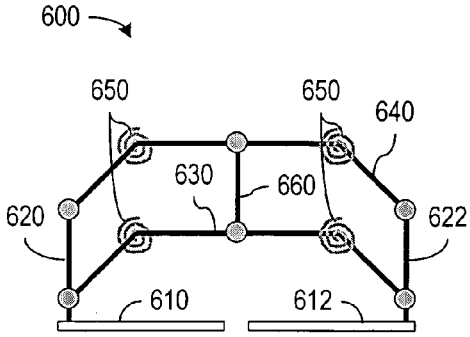
FIGS. 6A, 6B, 6C, and 6D show configurations of a multi-edge snowboard in accordance with an embodiment of the invention employing torsion springs.

FIGS. 6A, 6B, 6C, and 6D illustrate operation of a multi-edge snowboard 600 having an example of a structural spring-damper system. Multi-edge snowboard 600 otherwise includes boards 610 and 612, vertical links 620 and 622, and a drive link 660 that can be identical to corresponding structures described above. In snowboard 600, the structural spring-damping system includes torsion springs or flex points 650 at the four bends in horizontal links 630 and 640. FIG. 6A shows a configuration of multi-edge snowboard 600 when relaxed in a flat configuration where boards 610 and 612 are coplanar, e.g., when sitting on flat and level snow.

Figure 6B:
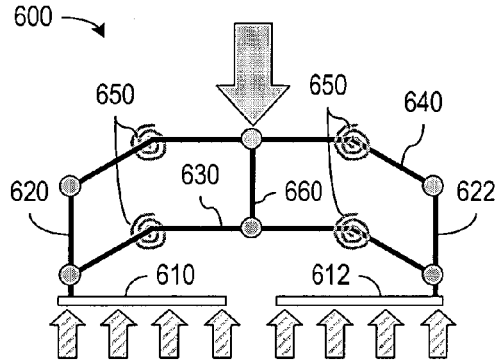

FIG. 6B shows snowboard 600 in the flat configuration when a snowboarder stands on snowboard 600. The snowboarder's weight and the supporting force of the snow under boards 610 and 612 cause vertical links 630 and 640 to splay out so that the snowboarder's elevation decreases. The spring constants of flex points 650 may differ from each other, and in the embodiment of FIG. 6B, are selected to keep boards 610 and 612 coplanar when compressing forces are applied to drive link 660 and boards 610 and 612. The splaying/spring action of flex points 650 is particularly useful when landing from a jump or when otherwise absorbing jolts. If desired, flex points 650 may include a nonlinear spring (e.g., a structure with a spring constant that increases with compression) so that the additional landing splay is minimal compared to the nominal splay arising from the weight of the snowboarder.

Figure 6C:
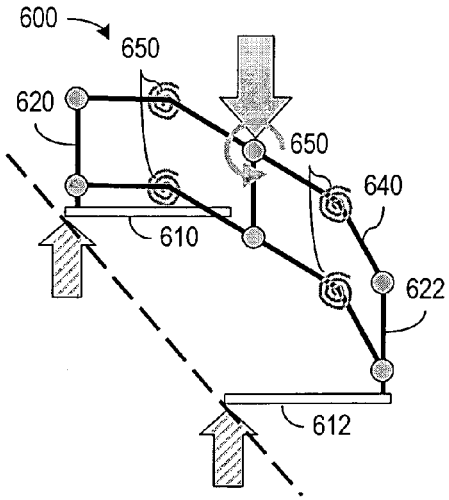
Figure 6D:
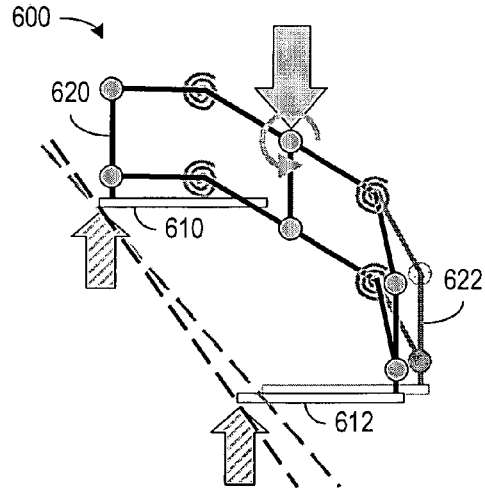
Figure 7A:
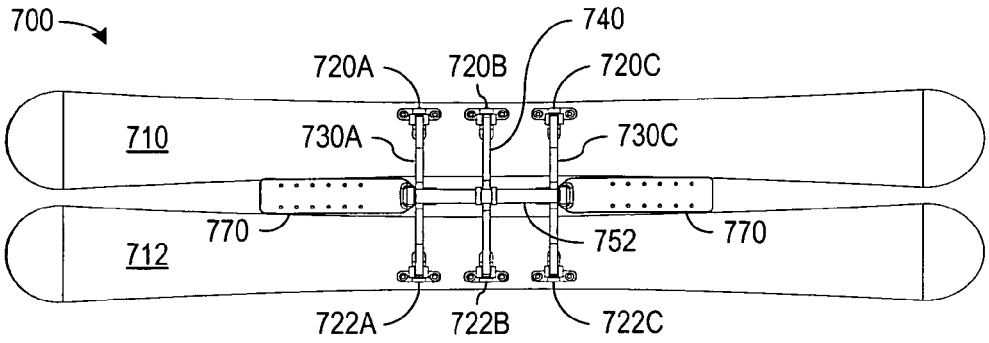
FIGS. 7A, 7B, 7C, and 7D respectively show top, side, isometric, and front views of a multi-edge snowboard in accordance with an enhanced embodiment having a shared top link for two four-bar mechanisms.
Figure 7B:
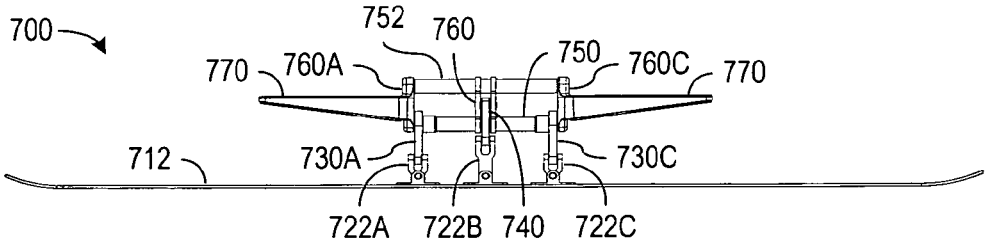
Figure 7C:
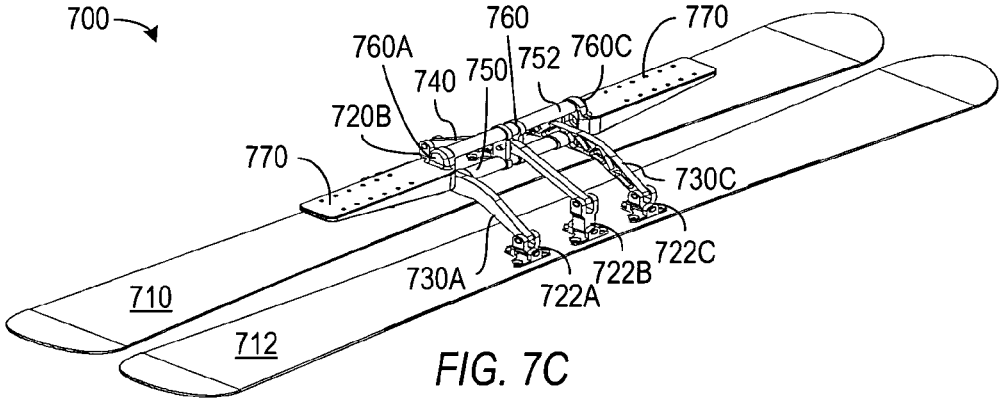
Figure 7D:
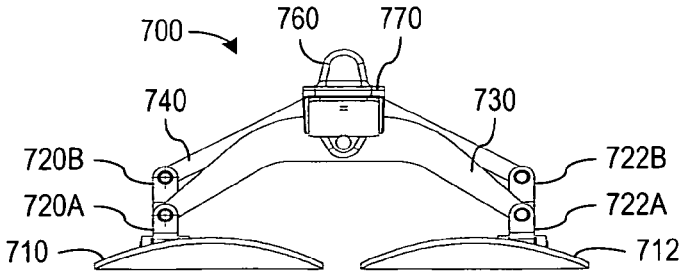

A useful side effect of having flex points 650 is the increase in the rotational range of boards 610 and 612, as illustrated in FIGS. 6C and 6D. In particular, almost immediately after initiating rotation that causes edges of boards 610 and 612 to engage a sloping surface, the outer or downhill board 612 begins to inwardly rotate, which increases the net rotation of the mechanism.

FIGS. 7A, 7B, 7C, and 7D show a multi-edge snowboard 700 in accordance with an embodiment of the invention employing a split multi-bar mechanism for drive and control of the attack angle of boards 710 and 712. This mechanism can be seen conceptually either as a single four-bar mechanism with two bottom horizontal links, or as two four-bar mechanisms that share a single top horizontal link. The multi-bar mechanism for snowboard 700 includes three vertical links 720A, 720B, and 720C attached to board 710 and three vertical links 722A, 722B, and 722C attached to board 712. In an exemplary embodiment, the mountings of vertical links 720A, 720B, 720C, 722A, 722B, and 722C include flex points or pivots that attach to respective boards and permit the tips of respective boards 710 and 712 move up and down so that the angle between vertical links 720A, 720B, 720C, 722A, 722B, and 722C and boards 710 and 712 may vary from a right angle. Such flex points or pivots have a rotation axis perpendicular to the lengths of boards 710 and 712 and can provide a further part of a spring-damper system such as described above in regard to FIGS. 6A, 6B, 6C, and 6D.

Upper pivots at the tops of vertical links attach a first lower horizontal link 730A to vertical links 720A and 722A, a second horizontal link 740 to vertical links 720B and 722B, and a third horizontal link 730C to vertical links 720C and 722C. These upper pivots on respective vertical links have rotation axes perpendicular to the axes of the lower pivots that attach the vertical links to respective boards 710 and 712, and generally the upper pivots provide a greater range of motion than do the lower pivots. Vertical links 720A, 722A, 720C, and 722C are shorter than vertical links 720B and 722B, so that horizontal links 730A and 730B are sometimes referred to herein as lower horizontal links. Horizontal link 740 is connected to the longer vertical links 720B and 722B and is sometimes referred to as the upper horizontal link. Horizontal links 730A, 730C, and 740 are arched as described above to improve mechanical strength and provide additional room for rotations of boards 710 and 712.

A structural subassembly on which the boarder rides includes a drive mechanism and is formed by the two opposing 770 cantilevers, which are rigidly connected to one another via bottom and top tubes 750 and 752, respectively. The two cantilevers 770 provide platforms on which bindings for a snowboarder can be mounted. With this configuration, a shift of a snowboarder standing on binding platforms 770 can cause platforms 770 to tilt, and a drive link 760 pivotally connected to tubes 750 and 752 and horizontal links 730A, 730C, and 740 causes upper horizontal link 740 to shift relative lower horizontal links 730A and 730C. In the same manner as in the four-bar mechanism described above, the shift of upper link 740 relative to lower links 730A and 730C tilts boards 710 and 712, thereby creating multiple edges that can act on underlying snow.

The control/drive mechanism of board 700 has several dimensions that can be adjusted to control the performance parameters of board 700. For example, the difference in the heights of vertical links (e.g., between links 720B and 720A) controls size of the horizontal shift of upper link 740 relative to lower links 730A and 730B required to achieve a specific attach angle for boards 710 and 712. Further, the ratio of the separation between tubes 750 and 752 and the separation between tube 750 and the pivot connecting drive link 760 to upper horizontal link 740 controls the relation between tilt of platform 770 and the relative shift of upper and lower links. In general, these dimensions can be made adjustable to accommodate individual snowboarders' preferences.

Although the invention has been described with reference to particular embodiments, the description is only an example of the invention's application and should not be taken as a limitation. In particular, although the above-described embodiments of the invention illustrated examples of snowboards, aspects of the current invention can be applied more generally to sliding devices employing edges of boards against supporting surfaces. For example, a mechanism as described above can be adapted so that the entire system operates as skis. Further, mechanisms as described above may be applied in handicapped snow sport gear, a snowmobile or other conveyance employing boards in contact with snow for steering. Various other adaptations and combinations of features of the embodiments disclosed are within the scope of the invention as defined by the following claims.

What is claimed is:

1. A snowboard comprising:

a plurality of boards;

a mechanism connecting the boards, wherein the mechanism causes relative movement of the boards to create multiple active edges; and a platform comprising a first cantilever attached to a first side of the mechanism and a second cantilever attached to a second side of the mechanism opposite to the first cantilever, wherein the first and second cantilevers provide spaces for a snowboarder to stand with the mechanism within an instep of the snowboarder while the snowboarder operates the mechanism to control the multiple active edges of the boards, wherein the mechanism comprises:

a first vertical link attached to a first of the boards;

a second vertical link attached to a second of the boards;

a first horizontal link attached to the first vertical link and the second vertical link, wherein an attachment of the first horizontal link to the first vertical link permits a change in an angle between the first horizontal link and the first vertical link, and an attachment of the first horizontal link to the second vertical link permits a change in an angle between the first horizontal link and the second vertical link;

a third vertical link attached to the first board; and a fourth vertical link attached to the second board, wherein the third and fourth vertical links are taller than the first and second vertical links;

a second horizontal link attached to the first and second boards via attachments to the third and fourth vertical links; and a drive link attached to the first horizontal link and the second horizontal link, wherein movement of the drive link shifts the first horizontal link relative to the second horizontal link and rotates the first and second boards.

2. A snowboard comprising:

a plurality of boards;

a mechanism connecting the boards, wherein the mechanism causes relative movement of the boards to create multiple active edges; and a platform comprising a first cantilever attached to a first side of the mechanism and a second cantilever attached to a second side of the mechanism opposite to the first cantilever, wherein the first and second cantilevers provide spaces for a snowboarder to stand with the mechanism within an instep of the snowboarder while the snowboarder operates the mechanism to control the multiple active edges of the boards, wherein the mechanism comprises:

a first vertical link attached to a first of the boards;

a second vertical link attached to a second of the boards;

a first horizontal link attached to the first vertical link and the second vertical link;

a universal joint that connects the first horizontal link to the first vertical link, wherein an attachment of the first horizontal link to the first vertical link permits a change in an angle between the first horizontal link and the first vertical link, and an attachment of the first horizontal link to the second vertical link permits a change in an angle between the first horizontal link and the second vertical link;

a second horizontal link attached to the first and second boards; and a drive link attached to the first horizontal link and the second horizontal link, wherein movement of the drive link shifts the first horizontal link relative to the second horizontal link and rotates the first and second boards.

3. A snowboard comprising:

a plurality of boards;

a mechanism connecting the boards, wherein the mechanism causes relative movement of the boards to create multiple active edges; and a platform comprising a first cantilever attached to a first side of the mechanism and a second cantilever attached to a second side of the mechanism opposite to the first cantilever, wherein the first and second cantilevers provide spaces for a snowboarder to stand with the mechanism within an instep of the snowboarder while the snowboarder operates the mechanism to control the multiple active edges of the boards, wherein the mechanism comprises:

a first vertical link attached to a first of the boards;

a second vertical link attached to a second of the boards;

a first horizontal link attached to the first vertical link and the second vertical link;

a ball joint that connects the first horizontal link to the first vertical link, wherein an attachment of the first horizontal link to the first vertical link permits a change in an angle between the first horizontal link and the first vertical link, and an attachment of the first horizontal link to the second vertical link permits a change in an angle between the first horizontal link and the second vertical link;

a second horizontal link attached to the first and second boards; and a drive link attached to the first horizontal link and the second horizontal link, wherein movement of the drive link shifts the first horizontal link relative to the second horizontal link and rotates the first and second boards.

4. A snowboard comprising:

a plurality of boards;

a mechanism connecting the boards, wherein the mechanism causes relative movement of the boards to create multiple active edges; and a platform comprising a first cantilever attached to a first side of the mechanism and a second cantilever attached to a second side of the mechanism opposite to the first cantilever, wherein the first and second cantilevers provide spaces for a snowboarder to stand with the mechanism within an instep of the snowboarder while the snowboarder operates the mechanism to control the multiple active edges of the boards, wherein the mechanism comprises:

a first vertical link attached to a first of the boards;

a second vertical link attached to a second of the boards;

a first horizontal link attached to the first vertical link and the second vertical link, wherein an attachment of the first horizontal link to the first vertical link permits a change in an angle between the first horizontal link and the first vertical link, and an attachment of the first horizontal link to the second vertical link permits a change in an angle between the first horizontal link and the second vertical link;

a second horizontal link attached to the first and second boards; and a drive link attached to the first horizontal link and the second horizontal link, wherein movement of the drive link shifts the first horizontal link relative to the second horizontal link and rotates the first and second boards, wherein the first vertical link comprises a first pivot and a second pivot, and wherein:

the first pivot connects to the first board and has a first rotation axis that is perpendicular to a length of the first board; and the second pivot connects the first link to the first horizontal link and has a second rotation axis perpendicular to the first rotation axis.

5. The snowboard of claim 4, wherein the second pivot provides a range of motion that is larger than a range of motion that the first pivot permits.

6. A snowboard comprising:

a plurality of boards;

a mechanism connecting the boards, wherein the mechanism causes relative movement of the boards to create multiple active edges; and a platform comprising a first cantilever attached to a first side of the mechanism and a second cantilever attached to a second side of the mechanism opposite to the first cantilever, wherein the first and second cantilevers provide spaces for a snowboarder to stand with the mechanism within an instep of the snowboarder while the snowboarder operates the mechanism to control the multiple active edges of the boards, wherein the mechanism comprises:

a first vertical link attached to a first of the boards;

a second vertical link attached to a second of the boards;

a first horizontal link attached to the first vertical link and the second vertical link, wherein an attachment of the first horizontal link to the first vertical link permits a change in an angle between the first horizontal link and the first vertical link, and an attachment of the first horizontal link to the second vertical link permits a change in an angle between the first horizontal link and the second vertical link;

a second horizontal link attached to the first and second boards; and a drive link attached to the first horizontal link and the second horizontal link, wherein movement of the drive link shifts the first horizontal link relative to the second horizontal link and rotates the first and second boards, wherein the first vertical link comprises a spring system that permits the tips of the first board to tilt relative to a length of the first vertical link.

7. A snowboard comprising:

a first board;

a second board;

a first vertical link attached to the first board and having a first height;

a second vertical link attached to the second board and having the first height;

a first horizontal link attached to top ends of the first vertical link and the second vertical link, wherein an attachment of the first horizontal link to the first vertical link permits a change in an angle between the first horizontal link and the first vertical link, and an attachment of the first horizontal link to the second vertical link permits a change in an angle between the first horizontal link and the second vertical link;

a third vertical link attached to the first board, wherein the third vertical link has a second height that differs from the first height and the third vertical link is separated from the first vertical link along a length of the first board;

a fourth vertical link attached to the second board, wherein the fourth vertical link has the second height and is separated from the second vertical link along a length of the second board;

a second horizontal link attached to top ends of the third vertical link and the fourth vertical link, wherein an attachment of the second horizontal link to the third vertical link permits a change in an angle between the second horizontal link and the third vertical link, and an attachment of the second horizontal link to the fourth vertical link permits a change in an angle between the second horizontal link and the fourth vertical link; and a fifth vertical link attached to the first board, wherein the fifth vertical link has the first height and is separated from the first and third vertical links along the length of the first board;

a sixth vertical link attached to the second board, wherein the sixth vertical link has the first height and is separated from the second and fourth vertical links along the length of the second board; and a third horizontal link attached to top ends of the fifth vertical link and the sixth vertical link, wherein an attachment of the third horizontal link to the fifth vertical link permits a change in an angle between the third horizontal link and the sixth vertical link, and an attachment of the third horizontal link to the sixth vertical link permits a change in an angle between the third horizontal link and the sixth vertical link, wherein the second horizontal link is between the first horizontal link and the third horizontal link along the lengths of the first and second boards; and a platform attached to the first, second, and third horizontal links, wherein the platform comprises a first cantilever extending from the first horizontal link and a second cantilever extending from the third horizontal link.

8. A snowboard comprising:

a first board;

a second board;

a first vertical link attached to the first board and having a first height;

a second vertical link attached to the second board and having the first height;

a first horizontal link attached to top ends of the first vertical link and the second vertical link, wherein an attachment of the first horizontal link to the first vertical link permits a change in an angle between the first horizontal link and the first vertical link, and an attachment of the first horizontal link to the second vertical link permits a change in an angle between the first horizontal link and the second vertical link;

a third vertical link attached to the first board, wherein the third vertical link has a second height that differs from the first height and the third vertical link is separated from the first vertical link along a length of the first board;

a fourth vertical link attached to the second board, wherein the fourth vertical link has the second height and is separated from the second vertical link along a length of the second board;

a second horizontal link attached to top ends of the third vertical link and the fourth vertical link, wherein an attachment of the second horizontal link to the third vertical link permits a change in an angle between the second horizontal link and the third vertical link, and an attachment of the second horizontal link to the fourth vertical link permits a change in an angle between the second horizontal link and the fourth vertical link; and a fifth vertical link attached to the first board, wherein the fifth vertical link is separated from the first and third vertical links along the length of the first board;

a sixth vertical link attached to the second board, wherein the sixth vertical link is separated from the second and fourth vertical links along the length of the second board;

a third horizontal link attached to the platform and attached to top ends of the fifth vertical link and the sixth vertical link, wherein an attachment of the third horizontal link to the fifth vertical link permits a change in an angle between the third horizontal link and the sixth vertical link, and an attachment of the third horizontal link to the sixth vertical link permits a change in an angle between the third horizontal link and the sixth vertical link; and a platform attached to the first and second horizontal links, wherein the platform is pivotally attached to the first, second, and third horizontal links so as to create a shared drive link.

9. The snowboard of claim 8, wherein the first vertical link attaches to the first board at a location that is closer to one of an inner edge of the first board and an outer edge of the first board.

* * * * *